US008997681B2

(12) United States Patent
Carr

(10) Patent No.: US 8,997,681 B2
(45) Date of Patent: Apr. 7, 2015

(54) AUTOMATED FLAG DISPLAY SYSTEM

(76) Inventor: Russell L. Carr, North Las Vegas, NV (US)

( * ) Notice: Subject to any disclaimer, the term of this patent is extended or adjusted under 35 U.S.C. 154(b) by 329 days.

(21) Appl. No.: 13/556,062

(22) Filed: Jul. 23, 2012

(65) Prior Publication Data

US 2013/0019793 A1 Jan. 24, 2013

Related U.S. Application Data

(60) Provisional application No. 61/510,393, filed on Jul. 21, 2011.

(51) Int. Cl.
*B63B 45/00* (2006.01)
*B63B 35/81* (2006.01)

(52) U.S. Cl.
CPC ..... *B63B 45/00* (2013.01); *B63B 35/815* (2013.01); *B63B 2201/00* (2013.01); *B63B 2201/26* (2013.01); *B63B 2221/24* (2013.01)

(58) Field of Classification Search
CPC .... B60Q 1/2657; B63B 35/81; B63B 35/815; B63B 35/816; B63B 35/85; B63B 45/04; B63B 2201/00; G09F 17/00; G09F 2017/0025; G09F 2017/0075; G09F 2017/0083
USPC ..... 116/26, 28 R, 173, 303; 114/253; 340/573.6, 984; 40/586, 607.04
See application file for complete search history.

(56) References Cited

U.S. PATENT DOCUMENTS 2,924,811 A * 2/1960 Popkess et al. ..... 116/39
3,091,757 A * 5/1963 Brock ..... 340/668
3,109,075 A * 10/1963 Ratcliff ..... 200/52 R
3,525,989 A * 8/1970 Fagan ..... 340/286.13
3,678,456 A * 7/1972 Gruber ..... 340/472
3,742,490 A * 6/1973 Henderson ..... 340/815.83
3,797,450 A * 3/1974 Frisbee ..... 116/28 R
3,798,631 A * 3/1974 Langford ..... 340/502
3,848,244 A * 11/1974 Young et al. ..... 340/665
4,807,557 A * 2/1989 Lodisio ..... 116/173
4,934,972 A 6/1990 Shumway et al.
4,962,720 A 10/1990 Leffel
5,024,179 A 6/1991 Leffel
5,398,026 A * 3/1995 Handsaker ..... 340/984
5,408,221 A * 4/1995 Carsella et al. ..... 340/604
5,694,337 A * 12/1997 Macken ..... 700/91
5,732,648 A * 3/1998 Aragon ..... 114/254

(Continued)

FOREIGN PATENT DOCUMENTS

FR 2810143 A1 * 12/2001 ..... G08B 21/00

*Primary Examiner* — R. A. Smith
(74) *Attorney, Agent, or Firm* — R. Whitney Johnson; Stoel Rives LLP

(57) ABSTRACT

Systems and methods for displaying a marine signaling device are disclosed. A flag coupled to a top section of a telescoping shaft includes a folding arm pivotally coupled to the top section that folds upward to gather the flag into alignment with the telescoping shaft. A housing couples to a boat and supports the shaft in the display configuration and receives the shaft in the storage configuration. As the shaft is retracted, the folding arm contacts an upper surface of the housing and gathers the flag into alignment with the shaft. A motor automatically extends/retracts the shaft based on detected tension on a tow rope mount of the boat or a tow rope coupled to the boat. A tension switch detects tension and activates the motor based on the detected tension. The tension switch may include arms that rotate in response to tension to activate a limit switch.

22 Claims, 5 Drawing Sheets

(56) References Cited

U.S. PATENT DOCUMENTS 6,057,787 A 5/2000 Kell et al.
8,368,560 B2 * 2/2013 McDonald ..... 340/984
2003/0036814 A1 * 2/2003 Middleton ..... 700/91
2007/0089663 A1 * 4/2007 Dunbar et al. ..... 116/173

* cited by examiner

AUTOMATED FLAG DISPLAY SYSTEM

RELATED APPLICATIONS

The present application claims benefit of priority under 35 U.S.C. §119(e) of U.S. Provisional Patent Application No. 61/510,393, filed Jul. 21, 2011, and titled "AUTOMATED FLAG DISPLAY SYSTEM," which is hereby incorporated herein by reference in its entirety.

TECHNICAL FIELD

The present disclosure relates generally to marine signaling devices. More specifically, the present disclosure relates to an automated system for displaying a marine signaling and/or warning device.

DETAILED DESCRIPTION

As will be readily understood, the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments. While the various aspects of the embodiments are presented in drawings, the drawings are not necessarily drawn to scale unless specifically indicated.

Figure 1:
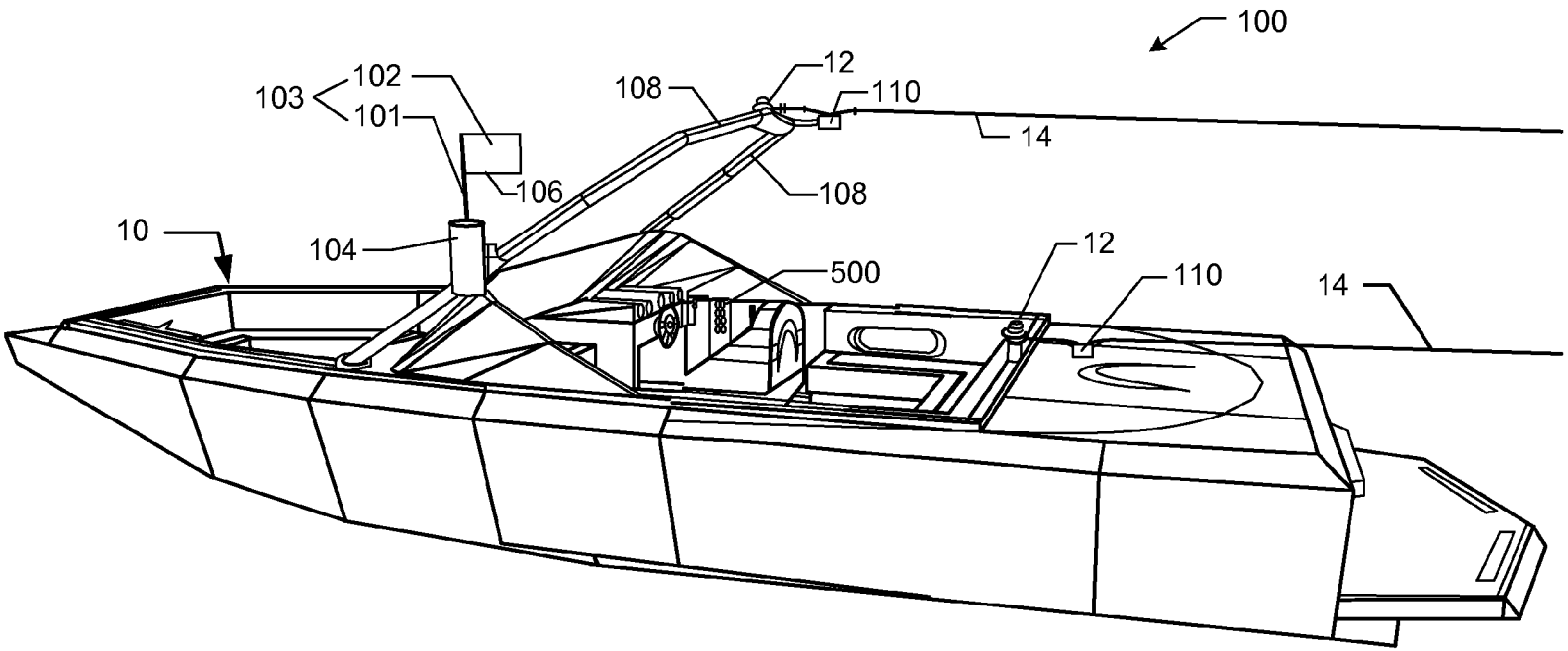
FIG. 1 is a perspective view of a boat having an automated flag display system with a flag in an elongated display configuration, according to one embodiment.

FIG. 1 is a perspective view of a boat 10 having an automated flag display system 100 with a flag 102 in a display configuration, according to one embodiment. The automated flag display system 100 may include a telescoping shaft 101 displaying a flag 102 or other signaling and/or warning device. The automated flag display system 100 may be utilized and/or configured on a boat 10 that is equipped with a tow rope 14 coupled to a tow rope mount 12.

The flag 102 is coupled toward an end (e.g., a top end) of the telescoping shaft 101. The flag 102 may be equipped with a folding arm 106 to aid in transitioning the flag 102 between an expanded and/or elongated display configuration or a compacted and/or shortened storage configuration. In the display configuration, the flag 102 may serve to signal or warn other boat users that a person or the rope 14 may be in the water. The flag 102 may be kept in the storage configuration when there may not be a person or rope 14 in the water and/or when no signal or warning may be needed.

The combination 103 of the telescoping shaft 101 and the flag 102 may be operative to transition between a shortened storage configuration and an elongated display configuration. In the storage configuration the telescoping shaft 101 may be retracted to a compact storage configuration and the flag 102 may also be in a compacted storage configuration hidden from view. The telescoping shaft and flag combination 103 may be connected to a motor housing 104.

The motor housing 104 may include a motor 214 (see FIG. 3) that may be operative to automatically extend or retract the telescoping shaft and flag combination 103 in response to, for example, fluctuations in tension detected by a tension switch 110. The motor housing 104 may be coupled by an electric wire 108 to the tension switch 110. In other embodiments, the motor 214 may be operative to transition the shaft and flag combination 103 between the storage configuration and the display configuration.

The tension switch 110 may detect and/or measure tension on the tow rope 14 and/or the tow rope mount 12. As should be appreciated, a plurality of tension switches 110 may be used.

In one embodiment, the tension switch 110 may include or be coupled to a tension detector. The tension detector may be configured to measure tension on the tow rope 14, as described in greater detail below with reference to FIGS. 6A-6B, 7A-7B, and 8. When tension on the tow rope 14 passes specific tension thresholds, the tension detector may activate the tension switch 110, and the tension switch 110 may activate the automated flag display system 100 to extend or retract the telescoping shaft and flag combination 103, and thereby transition the flag 102 and/or the telescoping shaft and flag combination 103 between the display configuration and/or the storage configuration. For example, a person water skiing, wake boarding, or other related activity may result in high tension on the tow rope 14 that may exceed a given high threshold. Depending on the laws and/or regulations of a given jurisdiction, tension surpassing the high threshold may be configured to signal to the motor housing 104 that the flag 102 may be retracted to the storage configuration.

In another embodiment, the tension switch 110 may include or be coupled to a strain gauge or other tension detector may be configured to measure tension on the tow rope mount 12. When tension on the tow rope mount 12 passes specific tension thresholds, the tension detector may activate the tension switch 110, and the tension switch 110 may activate the automated flag display system 100 to extend or retract the telescoping shaft and flag combination 103, and thereby transition the flag 102 and/or the telescoping shaft and flag combination 103 between the display configuration and/or the storage configuration. For example, a person water skiing, wake boarding, or other related activity may result in high tension on the tow rope mount 12 that may exceed a given high threshold. Depending on the laws and/or regulations of a given jurisdiction, tension surpassing the high threshold may be configured to signal to the motor housing 104 that the flag 102 may be retracted to the storage configuration.

When the rope is in the water, but there is not a load on the rope 14 (e.g., a person pulling on the rope 14, such as in the act of water skiing, wake boarding, or some other related activity) and the boat 10 is moving, the tension on the rope 14 and/or the tow rope mount 12 may be moderate (greater than a second low threshold but less than the high threshold). This condition or degree of tension may occur when a person that may have been water skiing, wake boarding, or some other activity has fallen and has let go of the rope 14. An end of the rope 14 in the water (and/or a rope handle) while the boat is moving may drag, which may result in moderate tension on the tow rope 14 and/or tow rope mount 12, less than the high threshold and greater than the low threshold, and the flag 102 may raise to the display configuration.

Displaying a flag 102 may be undesirable and/or not required by law when there is no person or rope in the water. This condition may result in little or no tension on the tow rope mount 12 (i.e., tension lower than the low threshold) and the flag 102 may retract to the storage configuration. The flag 102 may be required, however, when the boat is stopped and a person is floating in the water. A circuit in the tension switch 110 may provide for considering the time since a given level of tension is detected on the tow rope 14 and/or the tow rope mount 12 and indicate the telescoping shaft and flag combination 103 should remain in the raised display configuration until a time out period has expired.

Described differently, when the boat 10 is moving, one end of the rope 14 may be attached to the boat 10 at the tow rope mount 12, the other end of the rope 14 may be loose in the water and there may be moderate tension (or pressure) on the tow rope 14 and/or the tow rope mount 12 as the boat 10 is moving and dragging the rope 14 through the water. This moderate pressure may be detected by the tension detector and exceed, for example, the low threshold, such that the flag 102 may extend to the display configuration. (For example, a water skier has fallen and let go of the rope 14 and the boat 10 is circling back.) When the boat 10 is moving, one end of the rope 14 may be attached to the boat 10 at the tow rope mount 12, the other end of the rope 14 may be loose in the boat 10, and there may be little or no tension on the tow rope 14 and/or the tow rope mount 12. This little or no tension may or may not be detected by the tension detector and may be less than the low threshold, such that the telescoping shaft and flag combination 103 may retract to the storage configuration. (For example, the rope 14 has been pulled into the boat 10 after a water skier has finished an climbed back in the boat 10.) A timer may further be used to ensure the telescoping shaft and flag combination 103 are not prematurely retracted. When the boat 10 is moving, one end of the rope 14 may be attached to the boat 10 at the tow rope mount 12, the other end of the rope 14 may be pulled by a person, such as a water skier or wake boarder, and there may be high tension on the tow rope 14 and/or the tow rope mount 12. This high tension may be detected by the tension detector, and the flag 102 may retract to the storage configuration.

In another embodiment, a motion sensor (not shown) may be coupled to the engine, the throttle, and/or the speedometer of the boat 10 and to the tension switch 110. When the boat 10 is stationary for a specific period of time, the motion sensor may signal the tension switch 110 to signal the automated flag display system 100 to lower the flag 102 to its storage configuration.

As can be appreciated, tension thresholds and/or resulting actions (or configurations) of the automated flag display system 100 may be adjusted to accommodate for preferences and/or the laws or regulations of different jurisdictions regarding marine signaling devices, different boating activities, and/or different sizes and/or weights of participants of the boating activities.

Figure 3:
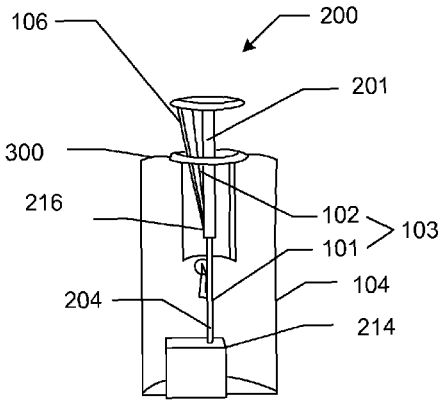
FIG. 3 is a side view of the flag device illustrated in FIG. 2 partially shortened and transitioning to a storage configuration.
Figure 5:
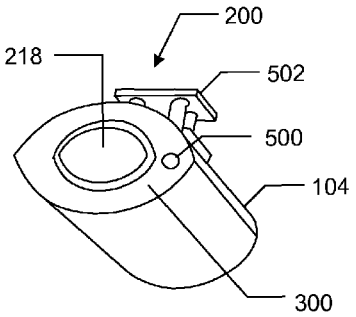
FIG. 5 is a top perspective view of the flag device illustrated in FIG. 2 in the storage configuration.

An up/down switch 500 may be positioned near a driver seat and/or an instrument console of the boat 10 for manual activation of the motor 214 (see FIGS. 3 and 5).

Figure 2:
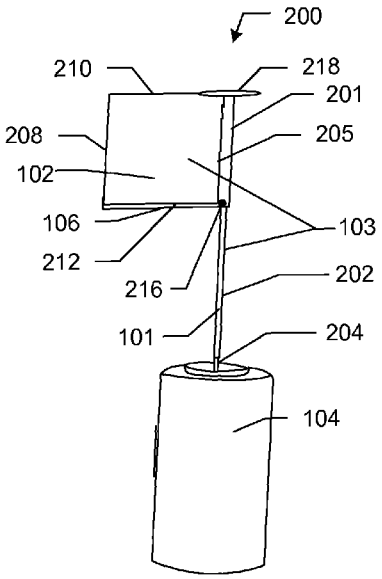
FIG. 2 is a side view of a flag device in an elongated display configuration, according to one embodiment.

FIG. 2 is a side view of a flag device 200 in an elongated display configuration, according to one embodiment. The flag device 200 may include a telescoping shaft 101 displaying a flag 102 or other signaling or warning device. The combination 103 of the telescoping shaft 101 and the flag 102 may be coupled to and/or supported by a motor housing 104. The flag 102 may also be equipped with a folding arm 106. The telescoping shaft 101 may include multiple sections, including a top section 201, one or more middle sections 202, and a bottom section 204. When the telescoping shaft 101 retracts to a storage configuration, the top section 201 may slide over the adjacent middle section 202, the middle section 202 may slide over any adjacent middle section 202 or sections, and the retracted top section 201 and middle section 202 may slide over the bottom section 204.

In another embodiment, the telescoping shaft 101 may retract to the storage configuration by the top section 201 sliding into the adjacent middle section 202, the middle section 202 sliding into any adjacent middle section 202 or sections, and the retracted top section 201 and middle section 202 sliding into the bottom section 204. The flag 102 may be coupled to an outer shaft of the top section 201, which may have a diameter large enough to slide over the retracted telescoping shaft 101. The outer shaft may couple to the top end of the top section 201 via a cap 218 secured to both the top end of the outer shaft and the top end of the top section 201. Accordingly, a portion or all of the top section 201 may be positioned coaxially inside of the outer shaft.

The flag 102 may include a leading edge 205, a trailing edge 208, a top edge 210 and a bottom edge 212. Other types of flags are also possible, such as a triangular flag. The flag 102 may be connected to and along a length of the top section 201 of the telescoping shaft 101 by stitching, adhesive or other means. The bottom section 204 of the telescoping shaft 101 may be connected to the motor housing 104. The motor housing 104 may include a motor 214 (see FIG. 3) that may be configured to automatically extend or retract the telescoping shaft and flag combination 103 in response to fluctuations in pressure detected by the tension switch 110 (see FIG. 1). In other embodiments, a signaling device other than the flag may be utilized, such as a light, a horn, a siren, or the like.

The folding arm 106 of the flag 102 may be coupled, for example, along a length of the bottom edge 212 of the flag 102. The folding arm 106 may be connected to the top section 201 of the telescoping shaft 101 by a pivotal joint 216. The pivotal joint 216 may allow the folding arm 106 to pivot from an orientation transverse or orthogonal to the top section 201 (and telescoping shaft 101) to an orientation parallel, or nearly parallel, to the top section 201 (and telescoping shaft 101).

In another embodiment, the folding arm 106 may be connected to an outer shaft of the top section 201 that may be enclosing the top section 201 of the telescoping shaft 101. The folding arm 106 may couple to the outer shaft by the pivotal joint 216. The pivotal joint 216 may allow the folding arm 106 to pivot from an orientation transverse or orthogonal to the outer shaft (and telescoping shaft 101) to an orientation parallel, or nearly parallel, to the outer shaft (and telescoping shaft 101).

FIG. 3 is a side view of the flag device 200 of FIG. 2 partially shortened and transitioning to the storage configuration, according to one embodiment. The telescoping shaft 101 is partially retracted. The top section 201 may be fully or partially retracted over the middle sections 202 and the bottom section 204. The folding arm 106 is partially rotated upward toward the telescoping shaft 101 and the flag 102 is partially gathered toward the telescoping shaft 101. When the telescoping shaft and flag combination 103 retracts to the storage configuration, the folding arm 106 may contact an upper surface 300 of the motor housing 104. This contact may cause the folding arm 106 to fold upward at the pivotal joint 216 to gather the flag 102 into alignment with the telescoping shaft 101. The upward rotation (or folding) of the folding arm 106 may allow the telescoping shaft and flag combination 103 to fully retract into the motor housing 104. As described above, the upward rotation (or folding) of the folding arm 106 may gather the flag 102 into alignment with the telescoping shaft 101 and thereby allow the telescoping shaft and flag combination 103 to be received into the motor housing 104.

Conversely, when the telescoping shaft 101 extends upward to the display configuration, the folding arm 106 may rotate downward at the pivotal joint 216 and away from the telescoping shaft 101. The weight of the folding arm 106 may cause the folding arm 106 to fall (e.g., rotate downward). The weight of the folding arm 106 may also cause the flag 102 to unfold as the distal end of the folding arm 106 falls and rotates away from the telescoping shaft 101.

In FIG. 3, a motor 214 of the motor housing 104 may be operatively coupled to the telescoping shaft 101 to automatically extend or retract the telescoping shaft and flag combination 103 in response to, for example, fluctuations in tension detected by a tension switch 110. In one embodiment, the motor 214 includes a drive cable or drive ribbon that may be configured to wind and/or unwind, as the motor 214 is activated, to extend and/or retract the telescoping shaft 101. The motor 214 may be coupled by an electric wire 108 to the tension switch 110.

Figure 4:
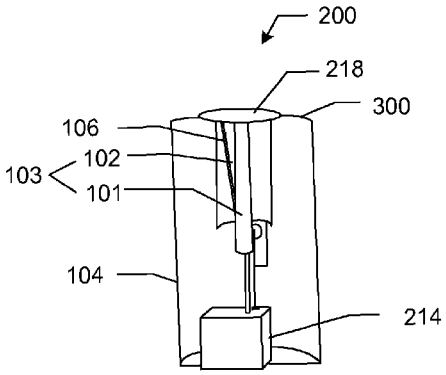
FIG. 4 is a side view of the flag device illustrated in FIG. 2 in the storage configuration.

FIG. 4 is a side view of the flag device 200 illustrated in FIG. 2 in the storage configuration, according to one embodiment. The telescoping shaft and flag combination 103 is in a fully shortened position. The telescoping shaft 101 may be fully retracted (or approximately fully retracted) and the flag 102 may be gathered toward the telescoping shaft 101. When the telescoping shaft and flag combination 103 is in the storage configuration, the cap 218 may rest flush with the upper surface 300 of the motor housing 104. The cap 218 may protect internal components of the motor housing 104 and/or the telescoping shaft and flag combination 103 while in the storage configuration within the motor housing 104. The folding arm 106 is oriented toward alignment with the telescoping shaft 101 (or at a relatively small angle), thereby gathering the flag 102 toward the telescoping shaft 101.

FIG. 5 is a top view of the flag device 200 illustrated in FIG. 2 in the storage configuration, according to one embodiment. The cap 218 may be disposed in abutment with the upper surface 300 of the motor housing 300. The top view of the flag device 200 shows one possible placement of an up/down switch 500 for manual activation of the motor 214 (FIGS. 3 and 4) for extension or retraction of the telescoping shaft and flag combination 103 on the upper surface 300 of the motor housing 104. For example, the up/down switch 500 may be used to prepare the flag device 200 for removal from the boat and/or for storage. The up/down switch 500 may comprise or be coupled to a hand-off-auto switch to allow an operator (e.g., an operator of the boat and/or of the automated flag display system) to override auto operation and control flag position using the up/down switch 500. As can be appreciated, in other embodiments, an up/down switch 500 may be positioned on the dash of the boat or at a location remote from the flag device 200, as shown in FIG. 1. A mounting plate 502 may enable the motor housing 104 to be coupled to a boat (or boat tower, etc.).

Figure 6A:
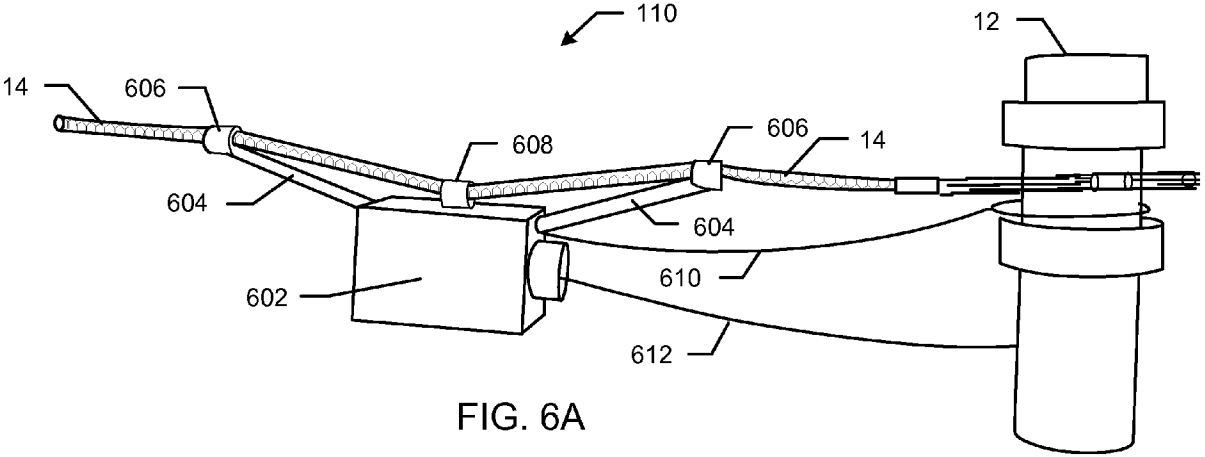
FIG. 6A is a perspective view of a tension switch in an inoperative state, according to one embodiment.
Figure 6B:
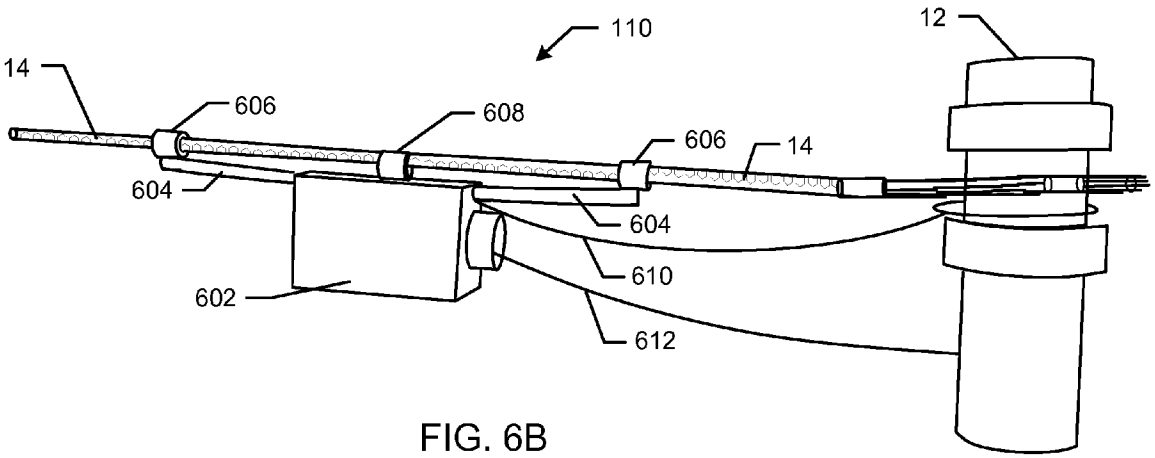
FIG. 6B is a perspective view of the tension switch of FIG. 6A in an operative state.

FIGS. 6A and 6B are perspective views of a tension switch 110 in an inoperative state and an operative state, respectively. In the illustrated embodiment, the tension switch 110 may be designed as a mechanical limit switch that activates upon tension reaching and/or exceeding a predetermined limit. The tension switch 110 may comprise a tension detector. The tension switch may include a housing 602, switch arms 604, switch eyelets 606, a center eyelet 608, a safety cable 610, and a wiring harness 612. The rope 14 is shown threaded through the switch eyelets 606 and center eyelet 608, as shown. The tension switch 110, when there is no tension on the rope 14, may be in an inoperative state, as shown in FIG. 6A. In the inoperative state, the tension switch 110 may hang loosely on the rope 14. The safety cable 610 may be attached to the tow rope mount 12 with the rope 14 (e.g., beneath the rope 14).

The switch arms 604 may be biased to the inoperative state, such that when there is little to no pressure pulling on or dragging the rope 14, the switch arms 604 may be in an angled or "V" shape. In other words, the switch eyelets 606 are positioned slightly higher than (and misaligned from) the center eyelet 608. The tension switch 110, when in the inoperative state of FIG. 6A, may be open and thus provide no signal to the motor 214 (FIGS. 3 and 4) and/or the telescoping shaft and flag combination 103 (FIG. 1), thereby providing no indication that the flag 102 should be raised/lowered.

Tension on the rope 14 may trigger the tension switch 110. When there is a certain predetermined amount of tension on the rope 14 (e.g., weight pulling on the rope 14), the rope straightens, causing the switch eyelets 606 to align with the center eyelet 608 in an operative state, as shown in FIG. 6B. Alignment of the switch eyelets 606 with the center eyelet 608 may cause the switch arms 604 to rotate relative to the housing 602, which may result in a mechanical shift that causes the tension switch 110 to close/open and activate the motor 214. For example, when the rope 14 is in use (e.g. pulling a water skier), and the boat accelerates, tension on the rope 14 causes the rope 14 to straighten, thus closing/opening the switch 110 by aligning the switch eyelets 606 with the center eyelet 608 and causing the switch arms 604 to rotate relative to the housing 602. When the tension switch 110 closes, a signal may be provided to the motor 214 (FIGS. 3 and 4) and/or telescoping shaft and flag combination 103, signaling that the flag 102 should be lowered/raised as configured and/or desired.

Figure 7A:
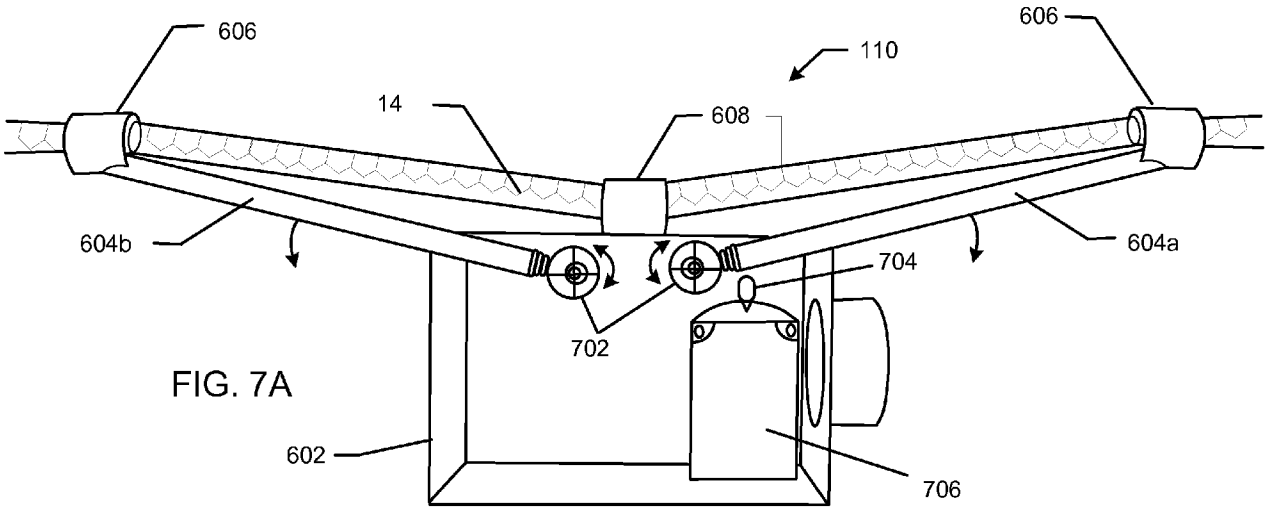
FIG. 7A is a partial sectional view of a tension switch in an inoperative state, according to one embodiment.
Figure 7B:
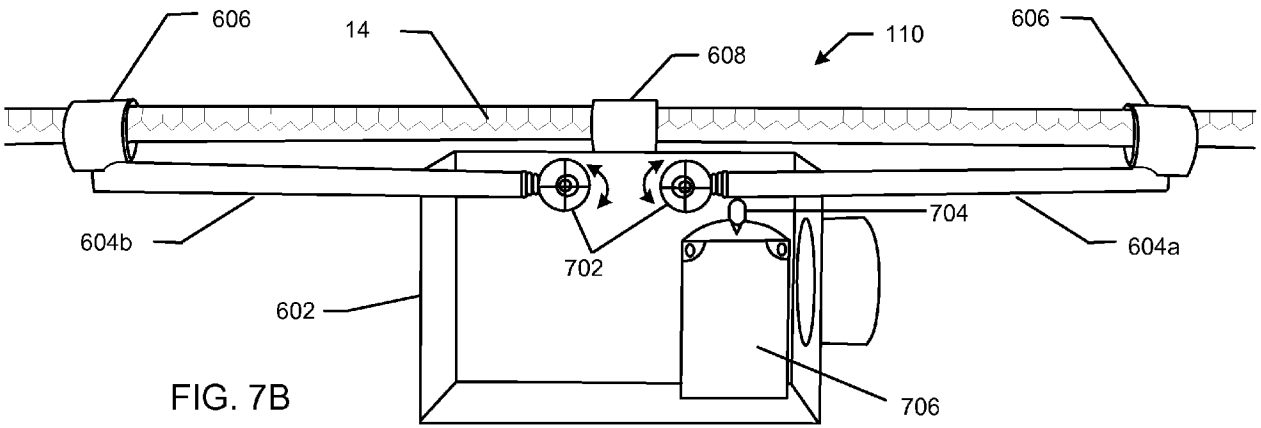
FIG. 7B is a partial sectional view of the tension switch of FIG. 7A in an operative state.

FIGS. 7A and 7B are partial sectional views of a tension switch 110 in an inoperative state and an operative state, respectively. The partial sectional views show the relative positions of the switch arms 604*a*, 604*b* (collectively 604) of the tension switch 110 in each of the inoperative state and the operative state. The switch arms 604 couple to the housing 602 at pivot points 702. The pivot points 702 may each comprise a tension spring, or other biasing element, that can be configured to define a degree of tension (or a threshold) to be achieved to activate the tension switch 110. In another embodiment, a biasing element such as a spring may be secured relative to the housing 602 and the switch arms 604 to bias the switch arms 604 upward and to define a threshold. A button 704 or other mechanical contact may be positioned below a first switch arm 604*a*. As the first switch arm 604*a* rotates downward, in response to tension on the rope 14, as shown in FIG. 7B, the first switch arm 604*a* contacts and depresses the button 704, activating a limit switch and/or other control circuitry 706. In short, depression of the button 704 by the first switch arm 604*a* may indicate a presence of tension on the rope 14 above a threshold set by the tension spring pivot points 702.

In the illustrated tension switch 110 of FIGS. 7A and 7B, a single button 704 and/or limit switch and/or control circuitry 706 is shown. In other embodiments, second button 704 may be provided for contact by the second switch arm 604*b*. The control circuitry 706 may be configured to be dual activated. In another embodiment, the tensions switch may include additional circuitry 706 that may be activated another button 704 being contacted by the second switch arm 604*b*. The tension switch 110 may be dual activated (e.g., both control circuitry closed/activated).

As can be appreciated, other devices and methods for detecting tension on the rope 14 and/or on a tow rope mount 12 may be utilized. For example, a strain gauge may be utilized.

Figure 8:
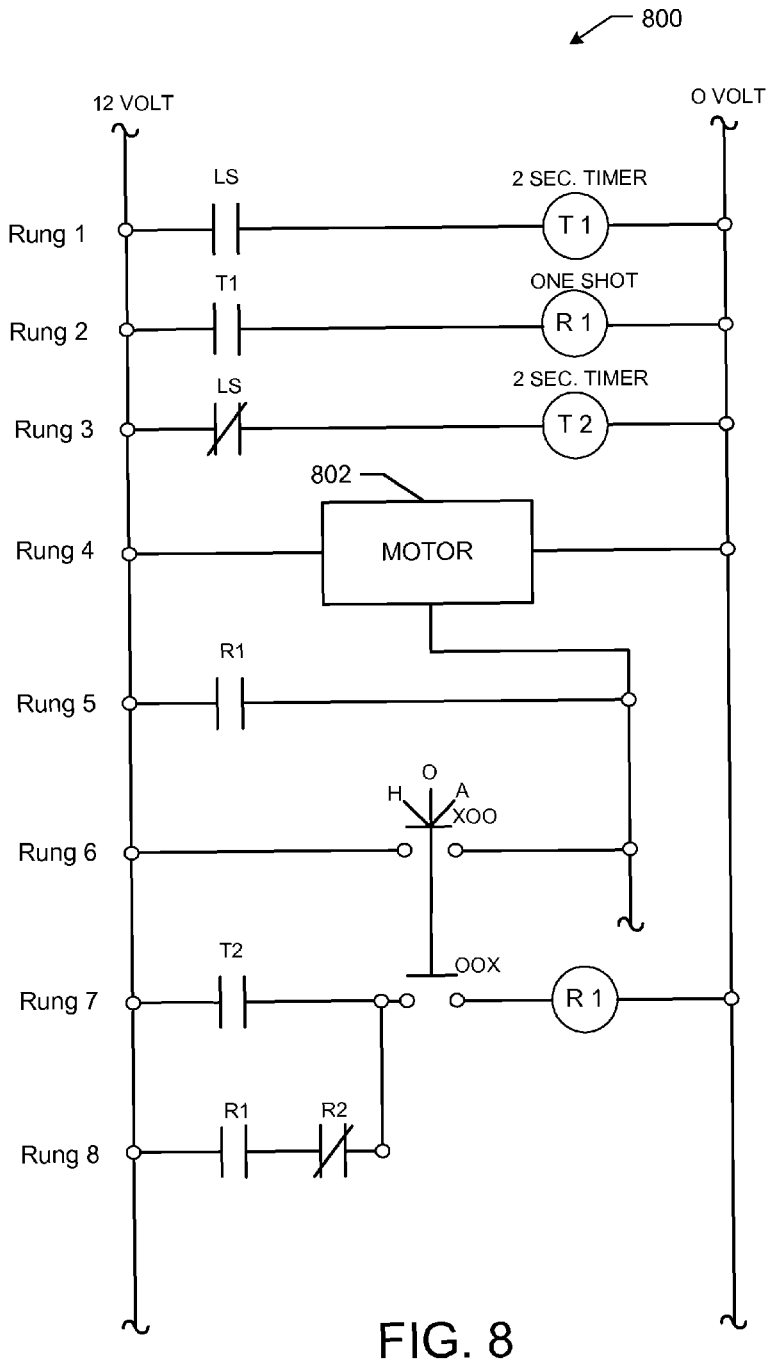
FIG. 8 is a ladder diagram of a tension switch circuit, according to one embodiment.

FIG. 8 is a ladder diagram 800 of a tension switch circuit, according to one embodiment. The illustrated diagram 800 illustrates one embodiment of circuitry of a tension switch, such as the tension switch 110 (of FIGS. 1, 6, and 7) that, upon detection of a threshold amount of tension, activates a motor, such as motor 214, to raise/lower a flag 102, or otherwise activate a signaling device.

The ladder diagram 800 includes eight rungs which describe different aspects of the tension switch circuit. The ladder diagram 800 depicts that the circuitry includes a limit switch LS, a first timer T1, a second timer T2, a one-shot relay R1, a second relay R2, a hand-off-auto (HOA) switch, and a motor 802.

The HOA switch is depicted in Rung 6. The HOA switch allows an operator to determine whether the circuit is in a manual mode (e.g., "hand" mode), an off mode, or an auto mode. When the circuit is in the manual mode, an activation switch, such as the up/down switch 500, can be used to activate a signaling device, such as activating the motor 214 to raise the flag 102. The auto mode is effectively overridden. In the off mode, the tension switch does not operate. The auto mode may function to automatically activate a signaling device.

First the auto mode operation is described. When the limit switch LS meets a specified limit (is activated by a predetermined force, e.g., lbs.), such as when a threshold level of tension is met or exceeded, a contact of the limit switch LS (which is normally open) closes and a first timer T1 activates and begins to count, as depicted by Rung 1 of the diagram 800. The first timer T1 may function to avoid limit switch chatter that may affect (e.g., negatively) the circuitry and/or flag control. The duration of the first timer T1 may be configured as desired, such as for example 2 seconds, to ensure that the detected tension is maintained for a desired period before activating the rest of the circuitry. Rung 3 depicts a limit switch LS contact that is normally closed. The threshold level of tension opens the limit switch LS contact in Rung 3, which prevents the second timer T2 from operating, and leaves the second timer T2 contact of Rung 8 closed.

Once the first timer T1 times out, the first timer T1 contact may close, which may drive the one shot relay R1, as depicted by Rung 2 of the diagram 800. The one shot relay R1 may provide a single relay signal, regardless of how long the tension remains on the limit switch LS. A first relay R1 contact closes and drives the second relay R2, as shown in Rung 7 (with the HOA switch in auto mode). The second relay R2 may comprise and/or drive a coil that may activate the motor 802 to drive the flag down to the retracted storage configuration. The second relay R2 contact of Rung 5 closes when the relay R2 is driven. Also, the second relay R2 contact in Rung 8 closes and, because the second timer T2 contact is normally closed, the second relay R2 seals itself and remains continually activated (and the second relay R2 contact in Rung 8 and the second relay R2 contact in Rung 5 remain closed).

If tension on the rope is discontinued (e.g., the rope is dropped) and the limit switch LS no longer meets the specified limit the limit switch LS contact of Rung 1 reverts to open (normal state), which causes the first timer T1 contact in Rung 2 to revert to open, which in turn ensures the one shot relay R1 contact of Rung 7 is open (if it was not already opened following the single signal of the one shot relay R1). Also, the limit switch LS contact of Rung 3 reverts to closed (normal state), which activates second timer T2. The duration of the second timer T2 may be configured as desired, such as for example 2 seconds. If the limit switch LS contact remains closed for the predetermined period of time (e.g., 2 seconds), then the second timer T2 contact in Rung 8 opens and deactivates the second relay R2. The second relay R2 no longer holds itself activated via Rung 8. Because neither the first relay R1 contact in Rung 7 or the second relay R2 contact in Rung 8 are closed, the second relay R2 is deactivated. The second relay R2 contact in Rung 5 is opened and the motor 802 is deactivated.

As can be appreciated, other circuitry may be utilized to translate a threshold level of tension into an activation signal to, for example, drive a motor or otherwise activate a signaling device.

In another embodiment, the circuitry may detect a first threshold, at which the flag should be raised/lowered as desired, and a second threshold at which the flag should be lowered/raised as desired.

While specific embodiments of automated flag display systems have been illustrated and described, it is to be understood that the disclosure provided is not limited to the precise configuration and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. The scope of the present invention should, therefore, be determined only by the following claims.

What is claimed is:

1. An automated system for displaying a marine signaling device, comprising:

a shaft configured to transition between a display configuration and a storage configuration;

a flag having a leading edge coupled to a portion of the shaft;

a motor coupled to the shaft and configured to automatically transition the shaft to the display configuration and automatically transition the shaft to the shortened storage configuration upon activation, wherein the motor is activated based on detected tension on one of a tow rope mount of a boat and a tow rope coupled to the boat; and a tension switch configured to detect tension on one of the tow rope mount and the tow rope coupled to the boat, the tension switch coupled to the motor to activate the motor based on the detected tension, wherein tension on the one of the tow rope mount and the tow rope above a first threshold and below a second threshold causes the tension switch to activate the motor to extend the shaft to the display configuration, and wherein tension on the one of the tow rope mount and the tow rope above the second threshold causes the tension switch to activate the motor to retract the shaft to the storage configuration.

2. The system of claim 1, wherein the shaft comprises a telescoping shaft having a plurality of sections including a top section and a bottom section, the top section slidably retractable relative to the bottom section such that the telescoping shaft is extendable to the display configuration and retractable to the storage configuration, wherein the flag is coupled to the top section.

3. The system of claim 2, wherein the top section of the telescoping shaft retracts over the bottom section.

4. The system of claim 2, wherein a portion of the top section of the telescoping shaft retracts within the bottom section, wherein the top section further comprises an outer shaft configured to retract over the bottom section and the flag couples to the top section along a length of the outer shaft.

5. The system of claim 2, further comprising a cap coupled to the top end of the top section of the telescoping shaft, the cap configured to engage with a housing when said telescoping shaft is in the shortened storage configuration.

6. The system of claim 2, the plurality of sections of the telescoping shaft further include one or more middle sections, the top section slidably retractable relative to the one or more middle sections, and the top and the one or more middle sections slidably retractable relative to the bottom section.

7. The system of claim 2, further comprising:

a folding arm extending along a length of and connected to a bottom edge of the flag and pivotally coupled to the top section of the telescoping shaft, the folding arm configured to fold upward and gather the flag into alignment with the telescoping shaft.

8. The system of claim 7, further comprising:

a housing configured to couple to a boat, to support the telescoping shaft in the elongated display configuration, and to receive the telescoping shaft when in the shortened storage configuration, wherein as the telescoping shaft is received in the housing the folding arm contacts an upper surface of the housing and gathers the flag into alignment with the telescoping shaft.

9. The system of claim 8, wherein tension on the one of the tow rope mount and the tow rope above a first threshold and below a second threshold causes the tension switch to activate the motor to extend the telescoping shaft out of the housing to the display configuration, and wherein tension on the one of the tow rope mount and the tow rope above the first threshold and above the second threshold causes the tension switch to activate the motor to retract the telescoping shaft into the housing to the storage configuration.

10. The system of claim 1, the tension switch configured to detect tension on the tow rope, the tension switch comprising:

a housing;

first and second switch arms pivotably coupled to and extending outward at opposite sides of the housing, the first and second switch arms each having a fixed end pivotably coupled to the housing and having a free end;

first and second switch eyelets disposed at the free ends of the first and second switch arms, respectively, the first and second switch eyelets aligned and configured to receive the tow rope;

a center eyelet disposed between the first and second switch eyelets at a fixed position relative to the tension detector housing, the center eyelet configured to receive the tow rope; and a biasing element coupled to at least one of the first and second switch arms, the biasing element configured to bias the at least one of the first and second switch arms toward an inoperative state angled upward and away from the tension detector housing such that the switch eyelets are positioned higher than and misaligned from the center eyelet, the biasing element defining a tension threshold of the tension switch, wherein, with the tow rope threaded through the first and second switch eyelets and the center eyelet, tension on the tow rope greater than the tension threshold causes the first and second switch eyelets to align with the center eyelet, thereby causing downward rotation of the free ends of the first and second switch arms relative to the tension detector housing, the rotation of at least one of the first and second switch arms closing a circuit to activate the motor.

11. The system of claim 10, wherein the tension switch further comprises:

a mechanical contact disposed below the first switch arm and configured to be contacted by the switch arm as the first switch arm rotates downward in response to alignment of the first and second switch eyelets and the center eyelet due to tension on the rope above the tension threshold of the tension switch.

12. The system of claim 1, the tension switch configured to detect tension on the tow rope mount, the tension switch comprising:

a strain gauge coupled to the tow rope mount.

13. The system of claim 1, further comprising a switch to manually activate the motor to transition the shaft between the display configuration and storage configuration.

14. The system of claim 1, further comprising a safety cable coupled to the tension switch and configured to attach to the tow rope mount and secure the tension switch relative to the tow rope mount.

15. A tension switch configured to measure tension on a tow rope coupled to a boat, the tension switch comprising:

a housing;

first and second switch arms pivotably coupled to and extending outward at opposite sides of the housing, the first and second switch arms each having a fixed end pivotably coupled to the housing and having a free end;

first and second switch eyelets disposed at the free ends of the first and second switch arms, respectively, the first and second switch eyelets aligned and configured to receive the tow rope;

a center eyelet disposed between the first and second switch eyelets at a fixed position relative to the tension detector housing, the center eyelet configured to receive the tow rope; and a biasing element coupled to at least one of the first and second switch arms, the biasing element configured to bias the at least one of the first and second switch arms toward an inoperative state angled upward and away from the tension detector housing such that the switch eyelets are positioned higher than and misaligned from the center eyelet, the biasing element defining a tension threshold of the tension switch, wherein, with the tow rope threaded through the first and second switch eyelets and the center eyelet, tension on the tow rope greater than the tension threshold causes the first and second switch eyelets to align with the center eyelet, thereby causing downward rotation of the free ends of the first and second switch arms relative to the tension detector housing, the rotation of at least one of the first and second switch arms closing a circuit to send an activation signal.

16. The tension switch of claim 15, further comprising:

a mechanical contact disposed below the first switch arm and configured to be contacted by the first switch arm as the first switch arm rotates downward in response to alignment of the first and second switch eyelets and the center eyelet due to tension on the rope above the tension threshold of the tension switch, wherein contact of the first switch arm and the mechanical contact closes the circuit to send the activation signal.

17. The tension switch of claim 16, further comprising:

a second mechanical contact disposed below the second switch arm and configured to be contacted by the second switch arm as the second switch arm rotates downward in response to alignment of the first and second switch eyelets and the center eyelet due to tension on the rope above the tension threshold of the tension switch, wherein contact of the second switch arm and the second mechanical contact closes the circuit to send the activation signal.

18. The tension switch of claim 17, wherein contact of both the mechanical contact and the second mechanical contact closes the circuit to send the activation signal.

19. The tension switch of claim 16, wherein the mechanical contact is a button of a limit switch.

20. The tension switch of claim 15, wherein the circuit closed by the mechanical contact includes a limit switch.

21. The tension switch of claim 15, further comprising a wiring harness configured to couple the tension switch to a motor of a flag device, wherein the activation signal is communicated through the wiring harness to activate the motor based on tension measurements.

22. The tension switch of claim 15, the flag device having a retractable shaft, wherein the activation signal activates the motor to extend or retract the retractable shaft of the flag device.

* * * * *